US011101589B2

(12) United States Patent
Gartenmaier et al.

(10) Patent No.: US 11,101,589 B2
(45) Date of Patent: Aug. 24, 2021

(54) CONNECTING PLUG AND SOCKET WITH LAMELLA BASKET

(71) Applicant: ODU GmbH & Co. KG, Mühldorf (DE)

(72) Inventors: Daniel Gartenmaier, Erlbach (DE); Alfred Mitter, Heldenstein (DE)

(73) Assignee: ODU GmbH & Co. KG, Mühldorf (DE)

( * ) Notice: Subject to any disclaimer, the term of this patent is extended or adjusted under 35 U.S.C. 154(b) by 0 days.

(21) Appl. No.: 16/599,467

(22) Filed: Oct. 11, 2019

(65) Prior Publication Data

US 2020/0119479 A1 Apr. 16, 2020

(30) Foreign Application Priority Data

Oct. 16, 2018 (EP) ..... 18200774

(51) Int. Cl.
*H01R 13/11* (2006.01)
*H01R 13/17* (2006.01)
*H01R 13/187* (2006.01)

(52) U.S. Cl.
CPC ..... *H01R 13/111* (2013.01); *H01R 13/17* (2013.01); *H01R 13/187* (2013.01)

(58) Field of Classification Search
CPC .... H01R 13/187; H01R 13/111; H01R 43/16; H01R 4/4881; H01R 43/20; H01R 13/33; H01R 2101/00; H01R 24/20; H01R 13/18; H01R 13/42; H01R 2103/00; H01R 11/22; H01R 12/585; H01R 13/10; H01R 13/11
See application file for complete search history.

(56) References Cited

U.S. PATENT DOCUMENTS 4,720,157 A * 1/1988 Nestor ..... H01R 13/187 439/843
5,667,413 A 9/1997 Trafton
5,951,337 A * 9/1999 Brake ..... H01R 13/17 439/825

(Continued)

FOREIGN PATENT DOCUMENTS

CN 109923737 A 6/2019
DE 1721306 U 5/1956

(Continued)

*Primary Examiner* — Edwin A. Leon
*Assistant Examiner* — Matthew T Dzierzynski
(74) *Attorney, Agent, or Firm* — Harris Beach PLLC; Laura W. Smalley

(57) ABSTRACT

A socket comprises an annular socket part and a lamella basket at least partly disposed in the interior of the annular socket part. The lamella basket comprises a plurality of lamellae and an annular carrier strip located at the rear part of the lamella basket. Each of the lamellae has a first end and a second end, with the first end being firmly attached to, or integrally moulded with, the annular carrier strip and with the second end being implemented as a free end. The lamellae extend from the annular carrier strip towards the front end of the socket. The inner surface of the annular socket part comprises a bulge that: protrudes in a radially inward direction; and is configured for supporting the lamellae when the lamellae are resiliently deformed in a radially outward direction.

15 Claims, 8 Drawing Sheets

(56) References Cited

U.S. PATENT DOCUMENTS

| | | | | |
|---|---|---|---|---|
| 6,752,668 | B2 * | 6/2004 | Koch, Jr. | H01R 13/187 439/387 |
| 2004/0248476 | A1 * | 12/2004 | Zhang | H01R 24/28 439/825 |
| 2014/0017960 | A1 | 1/2014 | Friedhof et al. | |
| 2020/0106231 | A1 * | 4/2020 | Katz | B21D 35/003 |

FOREIGN PATENT DOCUMENTS

| | | | |
|---|---|---|---|
| DE | 102004002402 | B3 | 11/2005 |
| DE | 202005015800 | U1 | 12/2005 |
| EP | 0967684 | A2 | 12/1999 |
| EP | 1182739 | A2 | 2/2002 |
| JP | H09289055 | A | 11/1997 |
| JP | 2002075501 | A | 3/2002 |
| JP | 2005536030 | A | 11/2005 |
| WO | WO-2004017465 | A2 | 2/2004 |
| WO | WO-20180093981 | A1 | 5/2018 |

* cited by examiner

CONNECTING PLUG AND SOCKET WITH LAMELLA BASKET

CROSS-REFERENCE TO RELATED APPLICATIONS

This application claims priority to European Patent Application No. 18 200 774.0, filed on Oct. 16, 2018, the disclosure of which is incorporated herein by reference in its entirety.

DESCRIPTION

Field of the Invention

The invention relates to a connecting plug with a lamella basket comprising a plurality of lamellae. The invention further relates to a socket with a lamella basket comprising a plurality of lamellae. The invention further relates to a plug-in connector comprising a connecting plug and a socket.

Background of the Invention

German utility model DE 20 2005 015 800 U1 describes a bunch plug with a plurality of wire springs. The plug comprises a base, with the respective first ends of the wire springs being inserted into said base. The plug further comprises a head, with the opposite ends of the wire springs being held in the head, wherein the head is firmly attached to the base. In order to conduct high currents, the wire springs have a contact length that corresponds to about 60% of the available length of the wire springs.

German utility model DE 1 721 306 U discloses a connector pin formed by wires arranged around a center pin, wherein a cap is mounted to the free end of the center pin, with the cap encompassing the wire ends. The cap is made of electrically conductive material.

German patent DE 10 2004 002 402 B3 describes an electric cable connection device. The electric cable connection device comprises a contact socket with elongated spring units configured for establishing an electric contact with multiple points of an electrically conductive pin element. The spring units are separated from each other by longitudinal slits. The spring units are pre-curved inwardly in the direction of the electrically conductive pin element in a desired contact area to lead to a contact adjustment of the contact socket on the pin element.

U.S. Pat. No. 5,667,413 A describes a socket-type electrical connector. A female electrical connector includes a housing defining a generally cylindrical bore therewithin. The connector includes a contact cage disposed, and retained, within the housing. The contact cage includes a number of contact blades disposed so as to provide a radial resilience. In some embodiments, an environmental seal is retained within the housing. The connector provides a high current capacity, low insertion force connector which may be readily fit over post-type electrical terminals.

OBJECT OF THE INVENTION

The object of the invention is to provide a connecting plug that is robust, provides a space-saving design and allows for a reliable operation. A further object of the invention is to provide a socket that is robust and allows for a reliable operation.

SUMMARY OF THE INVENTION

According to the invention, a connecting plug is provided. The connecting plug comprises a lamella basket comprising a plurality of lamellae, each of the lamellae having a first end and a second end, the first end being fixed and the second end being implemented as a free end. The connecting plug further comprises a holding element comprising a central body disposed in the interior of the lamella basket and a cap attached at or integrally moulded with the central body's front end, the cap having a protruding edge that projects from the central body in a radially outward direction, wherein the cap is shaped and configured for accommodating the respective second ends of the lamellae. Furthermore, the connecting plug comprises a base part, with a rear part of the lamella basket being attached to the base part. The lamella basket further comprises an annular carrier strip located at the rear part of the lamella basket, with the first end of each of the lamellae being firmly attached to or integrally moulded with the annular carrier strip, wherein the lamellae extend from the annular carrier strip to the holding element's cap.

The plug of the present invention comprises a plurality of lamellae, the lamellae being fixed at one end only, with the respective second end of the lamellae being a free end. Because of the free end, the lamellae can adapt to the respective shape of the socket's sidewalls, with the force required for compressing the lamellae being low. The connecting plug comprises a cap at the front end configured for accommodating the free ends of the lamellae, wherein a certain moving space for the respective free ends of the lamellae is provided. The cap is shaped and configured for covering and protecting the lamellae, in order to prevent a deformation or destruction of the lamellae. The lamella basket comprises an annular carrier strip located at the rear part of the lamella basket, wherein the lamella's first ends are firmly attached to the annular carrier strip. Thus all the lamellae are interconnected. Compared to a bunch plug comprising a plurality of wire springs, the lamella basket can be formed as one part, whereby handling and assembly are simplified. Because of the compact size of the lamella basket, it is possible to accomplish a space-saving design of the connecting plug. The rear ends of the lamellae are connected to the annular carrier strip, whereas the front ends are free. This simplifies the insertion of the plug. As the annular carrier strip is located in the rear part of the lamella basket, the annular carrier strip can be fixed to the plug's base part.

With regard to the connecting plug, terms such as "front end", "rear end", "front face", "rear part" relate to the connecting plug's mating direction. The mating direction of the connecting plug is the direction in which the plug is inserted into a socket. Accordingly, the front end of the connecting plug is the part of the plug that is inserted into the socket first. Also terms like "radially outward direction" or "radially inward direction" relate to the connecting plug's mating direction as the axial direction. An annular carrier strip is a strip of annular shape. Due to a manufacturing process like stamping, an annular carrier strip may comprise a gap. The term "annular carrier strip" denotes a strip that may be continuous or comprise a gap.

Further according to the invention, a connecting plug is provided. The connecting plug comprises a lamella basket comprising a plurality of lamellae, each of the lamellae having a first end and a second end, the first end being fixed and the second end being implemented as a free end. The connecting plug further comprises a holding element comprising a central body disposed in the interior of the lamella basket and a cap attached at or integrally moulded with the central body's front end, the cap having a protruding edge that projects from the central body in a radially outward direction, wherein the cap is shaped and configured for accommodating the respective second ends of the lamellae. Furthermore, the connecting plug comprises a base part, with a rear part of the lamella basket being attached to the base part. The cap consists of electrically insulating material.

The connecting plug comprises a lamella basket with a plurality of lamellae that are fixed at one end only, with the respective free ends being accommodated by the cap. The connecting plug's construction is suitable for realising a space-saving design. The cap consists of electrically insulating material. By providing a cap that is made of electrically insulating material, a touch protection at the connecting plug's front face is provided. Thus, it is prevented that the user gets in contact with live parts at the plug's front face.

Further according to the invention, a connecting plug is provided. The connecting plug comprises a lamella basket comprising a plurality of lamellae, each of the lamellae having a first end and a second end, the first end being fixed and the second end being implemented as a free end. The connecting plug further comprises a holding element comprising a central body disposed in the interior of the lamella basket and a cap attached at or integrally moulded with the central body's front end, the cap having a protruding edge that projects from the central body in a radially outward direction, wherein the cap is shaped and configured for accommodating the respective second ends of the lamellae. Furthermore, the connecting plug comprises a base part, with a rear part of the lamella basket being attached to the base part. The connecting plug comprises a supporting sleeve arranged in the interspace between the lamella basket and the holding element, the supporting sleeve being configured and shaped for providing a support for the lamellae.

The connecting plug comprises a lamella basket with a plurality of lamellae and a holding element with a central body disposed in the interior of the lamella basket. The connecting plug's construction form is suitable for realising a space-saving design. Between the holding element and the lamella basket, a supporting sleeve is arranged. The supporting sleeve is configured and shaped for providing a mechanical support for the lamellae of the lamella basket. Thus, severe deformation of the lamellae in the radially inward direction is prevented. Even in case the connecting plug is inserted into a socket in a slanted direction, the lamellae are protected from being damaged. The supporting sleeve may for example be a rigid sleeve. Alternatively, the supporting sleeve may for example comprise resilient fingers, the resilient fingers being configured for resiliently supporting the lamellae of the lamella basket.

Further according to the invention, a plug-in connector is provided, the plug-in connector comprising a connecting plug as described above and a socket, the connecting plug being adapted for being plugged into the socket and for establishing an electrical connection with the socket.

Yet further according to the invention, a socket is provided. The socket comprises an annular socket part and a lamella basket at least partly disposed in the interior of the annular socket part, the lamella basket comprising a plurality of lamellae and an annular carrier strip located at the rear part of the lamella basket. Each of the lamellae has a first end and a second end, with the first end being firmly attached to or integrally moulded with the annular carrier strip and with the second end being implemented as a free end, with the lamellae extending from the annular carrier strip towards the front end of the socket. The inner surface of the annular socket part comprises a bulge that stands out in a radially inward direction, wherein the bulge of the annular socket part is configured for supporting the lamellae when the lamellae are resiliently deformed in a radially outward direction.

The socket comprises a lamella basket with a plurality of lamellae and an annular socket part configured for encompassing the lamella basket. The inner surface of the annular socket part comprises a bulge that serves as a mechanical support for the lamellae when the lamellae are deformed in a radially outward direction. The bulge is configured for preventing severe deformation of the lamellae in the radially outward direction. Even in case a connecting plug is inserted into the socket in a slanted direction, the lamellae are protected from being damaged.

With regard to the socket, terms such as "front end", "rear end", "front face", "rear part" relate to the socket's mating direction. Accordingly, the front end of the socket is the part of the socket that receives the plug's front end first. Also terms like "radially outward direction" or "radially inward direction" relate to the socket's mating direction as the axial direction. An annular carrier strip is a strip of annular shape. Due to a manufacturing process like stamping, an annular carrier strip may comprise a gap. The term "annular carrier strip" denotes a strip that may be continuous or comprise a gap.

Yet further according to the invention, a plug-in connector is provided, the plug-in connector comprising a socket as described above and a connecting plug, the connecting plug being adapted for being plugged into the socket and for establishing an electrical connection with the socket.

PREFERRED EMBODIMENTS OF THE INVENTION

Preferred features of the invention which may be applied alone or in combination are discussed below and in the dependent claims.

Plug with a Lamella Basket

Preferably, the lamellae are implemented as resilient lamellae. Further preferably, the lamellae are configured for being elastically deformed in a radial direction. For example, when the connecting plug is inserted into a socket, the lamellae may be resiliently compressed in the radially inward direction. The deformed lamellae are pressed against the sidewalls with a certain spring force, thereby establishing an electrical contact of low resistance.

Preferably, each of the lamellae at the lamella basket's outer surface is a convex curved lamella. Due to the convex shape, the lamellae are smoothly compressed when the plug is inserted into the socket.

Preferably, the lamella basket comprises an annular carrier strip. Preferably, the annular carrier strip is configured for interconnecting the lamellae. The annular carrier strip provides for an improved stability, wherein handling and assembly of the lamella basket are simplified.

Preferably, the lamella basket's annular carrier strip is located at the rear part of the lamella basket. Further preferably, the first end of each of the lamellae is firmly attached to the annular carrier strip. Thus, the respective fixed end of each lamella is located in the rear part of the connecting plug, whereas the free end of each lamella faces towards the front end. In a preferred embodiment, the lamellae of the lamella basket are integrally formed with the annular carrier strip. For example, both the annular carrier strip and the plurality of lamellae can be formed in one single piece, which simplifies manufacturing of the lamella basket.

In a preferred embodiment, the lamellae extend from the annular carrier strip to the holding element's cap. For example, the lamellae may extend from the annular carrier strip along the lateral sides of the connecting plug towards the cap. Preferably, each of the lamellae extends from the annular carrier strip to the holding element's cap predominantly in the mating direction of the connecting plug. Preferably, the predominant component of the lamellae's orientation is the component in the mating direction of the connecting plug. Hence, the lamellae extend predominantly in the connecting plug's mating direction along the sidewalls of the plug.

Preferably, the lamella basket comprises at least 10 lamellae, further preferably at least 16 lamellae, further preferably at least 20 lamellae, further preferably at least 24 lamellae. Preferably, the lamella basket comprises less than 100 lamellae, further preferably less than 70 lamellae, further preferably less than 50 lamellae, further preferably less than 35 lamellae.

Preferably, the lamella basket's diameter amounts to at least 30%, further preferably at least 50%, further preferably at least 70%, further preferably at least 90% of the lamella basket's height in the mating direction of the connecting plug. Preferably, the lamella basket's diameter amounts to at most 300%, further preferably at most 200%, further preferably at most 150%, further preferably at most 120% of the lamella basket's height in the mating direction of the connecting plug.

Preferably, the lamellae extend over at least 50%, further preferably at least 60%, further preferably at least 65% of the lamella basket's height in the mating direction of the connecting plug. Preferably, the lamellae extend over at most 90%, further preferably at most 80%, further preferably at most 75% of the lamella basket's height in the mating direction of the connecting plug. Further preferably, the annular carrier strip extends over at least 10%, further preferably at least 20%, further preferably at least 25% of the lamella basket's height in the mating direction of the connecting plug. Preferably, the annular carrier strip extends over at most 45%, further preferably at most 40%, further preferably at most 35% of the lamella basket's height in the mating direction of the connecting plug.

Preferably, the lamella basket consists of conductive material. Further preferably, the lamella basket consists of metal, preferably of a copper alloy such as for example a copper-nickel (CuNi) alloy or a copper-chromium (CuCr) alloy. Preferably, the lamellae consist of metal, preferably of a copper alloy like for example a CuNi alloy or a CuCr alloy. Preferably, the annular carrier strip consists of metal, preferably of a copper alloy like for example a CuNi alloy or a CuCr alloy. Preferably, the lamella basket or parts thereof may be subjected to plating, for example with gold, silver or copper. In a preferred embodiment, the lamella basket is formed as a stamped part, further preferably as a stamp-rolled or a stamp-bent part. For example, a lamella strip may be formed by stamping, and then, the lamella strip may be rolled to form the lamella basket.

Preferably, the cap's protruding edge overlaps with the second ends of the lamellae and is configured for holding the second ends of the lamellae in place. The cap is configured for covering the second ends of the lamellae and for protecting the lamellae from being deformed.

In a preferred embodiment, the cap comprises a recess or a groove or at least one indentation located at the rear side of the cap. Preferably, the cap comprises a circumferential recess or a circumferential groove or a circumferential indentation located at the rear side of the cap.

Preferably, the second ends of the lamellae extend into the recess or the groove or the at least one indentation located at the rear side of the cap. For example, the recess or the groove or the at least one indentation located at the rear side of the cap may be configured for accommodating the respective second ends of the lamellae. Preferably, the recess or the groove or the at least one indentation is shaped and configured for providing a predefined moving space to the respective second ends of the lamellae. The recess, the groove or the at least one indentation provides enough moving space to allow for a restricted movement of the second ends of the lamellae. For example, when a lamella is compressed, its second end may be further pushed into the recess, the groove or the indentation. Yet, the lamellae are held in place by the cap, with the cap being configured for protecting the lamellae from being deformed or destroyed.

Preferably, the cap is shaped and configured for accommodating the respective second ends of the lamellae and for preventing insertion of any counterpart into an interspace between the lamellae and the holding element. Even in case the connecting plug not inserted correctly, deformation and destruction of the lamellae are avoided.

Preferably, the cap is shaped and configured for pressing the second ends of the lamellae in a radially inward direction and for exerting a pretension onto the lamellae. Due to this pretension, a better alignment of the lamellae is accomplished.

Preferably, the central body is a solid central body configured for being disposed in the interior of the lamella basket. According to an alternatively preferred embodiment, the central body is a central sleeve configured for being disposed in the interior of the lamella basket. Preferably, the cap is a ring-shaped cap. Further preferably, the holding element comprises a central sleeve and a ring-shaped cap.

Preferably, the ring-shaped cap's inner diameter is at least 40%, further preferably at least 50%, further preferably at least 55% of the ring-shaped cap's outer diameter. Preferably, the ring-shaped cap's inner diameter is at most 70%, further preferably at most 60%, further preferably at most 55% of the ring-shaped cap's outer diameter.

Preferably, the cap consists of electrically insulating material. Preferably, the cap consists of at least one of the following: plastic material, polymer material, an elastomer, natural rubber, synthetic rubber. Preferably, the cap is configured for providing a touch protection at the connecting plug's front face. By providing a cap made of insulating material at the plug's front face, it is prevented that the user gets in contact with live parts at the plug's front face.

Preferably, the holding element is an insulating element. Preferably, the holding element consists of insulating material, in particular of at least one of the following: plastic material, polymer material, an elastomer, natural rubber, synthetic rubber. Preferably, the holding element is an injection moulded part.

Preferably, each lamella comprises at least one contact area. Further preferably, each lamella comprises a contact area that stands out in the radially outward direction, said contact area being configured for establishing an electrical contact with a socket. For example, the contact area that stands out in a radially outward direction may be pressed against the sidewalls of the socket. Preferably, each lamella comprises a contact area, the contact area being a bulge of the lamella that stands out in a radially outward direction of the connecting plug.

Preferably, the connecting plug is configured for being inserted into a socket and for establishing an electric contact with the socket. Preferably, the lamellae are configured for establishing an electrical connection with side walls of a socket when plugged into the socket.

In a preferred embodiment, respective contact areas of the various lamellae are located at least two different longitudinal positions when viewed in the mating direction of the connecting plug. When the connecting plug is inserted into the socket, different subsets of the lamellae are deformed subsequently at different points of time. As the force required for deforming a subset of the lamellae is smaller than the force required for deforming all the lamellae, the total insertion force is reduced.

Preferably, for a first subset of lamellae, the lamellae's contact areas are located at a first longitudinal position, wherein for a second subset of lamellae, the lamellae's contact areas are located at a second longitudinal position, wherein the lamellae of the first and the second subset are disposed alternatingly around the circumference of the lamella basket, the second longitudinal position being different from the first longitudinal position.

In a preferred embodiment, the connecting plug comprises a supporting sleeve arranged in the interspace between the lamella basket and the holding element. Preferably, the supporting sleeve is a sleeve of essentially cylindrical shape. Preferably, the supporting sleeve extends in the mating direction of the connecting plug and is configured and shaped for providing a support for the lamellae. The supporting sleeve may for example be configured for preventing a deformation of the lamellae in a radially inward direction. Preferably, the supporting sleeve extends in the mating direction and is configured and shaped for preventing a plastic deformation of the lamellae. For example, in case the connecting plug is inserted into the socket in a slanted orientation, severe deformation of the lamellae is prevented.

Preferably, the supporting sleeve extends in the connecting plug's mating direction and comprises a plurality of supporting lamellae, the supporting lamellae being configured for resiliently supporting the lamellae of the lamella basket. Further preferably, the supporting lamellae of the supporting sleeve are configured for resiliently supporting the lamellae of the lamella basket and for augmenting the contact normal force of the lamella basket's lamellae. The advantage of this embodiment is that the relaxation resistance of the lamellae is improved. This embodiment is particularly suitable for high-temperature environments, e.g. with temperature of above 200° C., where due to the temperature the elasticity of the lamellae of the lamella basket may be compromised. The lamellae of the lamella basket and the supporting lamellae of the supporting sleeve element preferably are made of different materials. In general, materials with a high electrical conductivity have a lower relaxation temperature, resulting in a reduced resilience at high temperatures. By choosing different materials for the lamellae of the lamella basket and the supporting lamellae of the supporting sleeve, advantageously a high electrical conductivity and a sufficient resilience at high temperature can be achieved. Preferably, both materials are metals. The lamella basket preferably has a higher electrical conductivity than the supporting sleeve. The supporting sleeve preferably has a higher relaxation temperature than the lamella basket. Preferably, the relaxation temperature of the material of the supporting sleeve is above 250° C., more preferably above 300° C. The relaxation temperature of the material of the lamella basket preferably is below 200° C., more preferably below 160° C. Preferably, the lamella basket is made of copper or a material comprising copper, e.g. a copper alloy. Copper has a relaxation temperature of approximately 100° C., copper/tin alloy typically has a relaxation temperature of between 120 and 130° C., and copper/beryllium alloy typically has a relaxation temperature of between 140 and 150° C. The supporting sleeve preferably is made of steel, more preferably of stainless steel. The relaxation temperature of stainless steel typically is above 300° C. Thus, even at temperature as high as 250° C. or even 300° C. high electrical conductivity and sufficient resilience can be achieved.

Preferably, the supporting sleeve consists of metal, preferably of steel, for example of stainless steel. Further preferably, the supporting sleeve is a turned part or a deep drawn part.

According to a preferred embodiment, the base part comprises a receptacle at its front end, the receptacle being configured for accommodating the lamella basket's annular carrier strip. Preferably, the receptacle is configured for accommodating the lamella basket's annular carrier strip and at least one of the holding element and a supporting sleeve.

Preferably, at least one of the following components is rotationally symmetric: the lamella basket, the holding element, a supporting sleeve, the base part, with a respective axis of rotation corresponding to the mating direction of the connecting plug. Preferably, the lamella basket's annular carrier strip, a rear part of the holding element and a rear part of a supporting sleeve are arranged coaxially.

Preferably, the lamella basket's annular carrier strip is configured for being fixed in the receptacle by means of a press fit. A press fit allows for establishing a stable connection between the lamella basket and the base part. Further preferably, the connecting plug comprises a supporting sleeve arranged in the interior of the lamella basket, the supporting sleeve being configured for acting as a counterpart of the encompassment of the base part's receptacle when establishing the press fit. Preferably, the lamella basket's annular carrier strip is tightly fixed between the supporting sleeve and the base part's receptacle. Further preferably, both the lamella basket's annular carrier strip and a rear part of the supporting sleeve are fixed in the receptacle by means of a press fit.

Preferably, the lamella basket's annular carrier strip comprises at least one creasing, wherein at least one of the creasings is deformed when establishing the press fit. By deforming the creasings, a more stable press fit and an improved current transfer are accomplished.

According to a preferred embodiment, the holding element is fastened on the base part. Preferably, the base part comprises a connecting element located at the bottom of the receptacle, the connecting element being configured for fixing the holding element disposed in the interior of the lamella basket. Further preferably, the connecting element is configured for extending through a bore hole at the bottom of the holding element, wherein the connecting element is configured for being fastened by flanging. Preferably, the base part comprises a bore hole at its rear end, the bore hole being configured for mounting the base part by means of a thread forming screw.

Preferably, the base part consists of conductive material. Further preferably, the base part consists of metal, in particular of a copper alloy, such as for example brass or a copper-tellurium (CuTeP) alloy. Further preferably, the base part is a turned part or a part formed by impact extrusion.

Plug-in Connector Comprising a Connecting Plug as Described Above and a Socket

A plug-in connector according to the invention comprises a connecting plug as described above and a socket, the connecting plug being adapted for being plugged into the socket and for establishing an electrical connection with the socket. Preferably, the socket is a stamped part. Further preferably, the socket is made of sheet material.

Socket with a Lamella Basket

Preferably, the lamellae are implemented as resilient lamellae. Further preferably, the lamellae are configured for being elastically deformed in a radially outward direction. For example, when a plug is inserted into a socket, the lamellae may be resiliently deformed in the radially outward direction. The deformed lamellae of the socket are pressed against the plug with a certain spring force, thereby establishing an electrical contact of low resistance.

Preferably, the annular carrier strip is configured for interconnecting the lamellae. The annular carrier strip provides for an improved stability, wherein handling and assembly of the lamella basket are simplified.

Preferably, the lamella basket's annular carrier strip is located at the rear part of the lamella basket when viewed in the socket's mating direction. Preferably, the first end of each of the lamellae is firmly attached to the annular carrier strip. Thus, the respective fixed end of each lamella is located in the rear part of the socket, whereas the free end of each lamella faces towards the front end of the socket. Hence, a plug may for example be inserted with low insertion force. In a preferred embodiment, the lamellae of the lamella basket are integrally formed with the annular carrier strip. For example, the annular carrier strip and the plurality of lamellae can be formed in one single piece.

Preferably, the lamellae extend from the annular carrier strip along the inner surface of the annular socket part towards the front end of the socket. The lamellae may for example extend along the inner sidewalls of the annular socket part. Preferably, each of the lamellae extends from the annular carrier strip to the front end of the socket predominantly in the mating direction of the socket. Preferably, the predominant component of the lamellae's orientation is the component in the mating direction of the socket.

According to a preferred embodiment, the contour of the annular socket part's inner surface corresponds to the contour of the rear side of a resiliently deformed lamella. Preferably, the inner surface of the annular socket part and the rear surface of a resiliently deformed lamella are of complementary shape. Thus the inner surface of the annular socket part can serve as a support for the lamellae. Preferably, the inner surface of the annular socket part is configured for acting as a supporting surface for the lamellae when the lamellae are resiliently deformed in a radially outward direction. Preferably, a supporting surface is a surface configured for supporting the resiliently deformed lamellae in a way that they are not damaged.

Preferably, the rear surface of the resiliently deformed lamellae is a concave shaped surface. Further preferably, the inner surface of the annular socket part is a convex curved surface that stands out in a radially inward direction. In this regard, the inner surface of the annular socket part is shaped and configured for supporting the rear surface of the lamellae.

Preferably, the contour of the annular socket part's inner surface corresponds to a deflection curve of the resiliently deformed lamellae. For example, the deflection curve of the resiliently deformed lamellae may be determined in advance. In this regard, each lamella may for example be treated as a bending beam. Preferably, for calculating the deflection curve, the progression of the area moments of inertia along the lamella is taken into account. For example, a lamella may taper in the direction from the fixed end to the free end, which means that the cross sectional area of a lamella decreases in the direction towards the lamella's free end. Also in a case like this, the deflection curve is capable of considering the specific shape of the lamella, because the progression of the area moment of inertia along the lamella is taken into account when determining the deflection curve.

Preferably, at least one of the lamellae comprises a bulge that stands out in a radially inward direction. For example, the bulge may be configured as a contact area configured for establishing an electric connection with a contact portion of a connecting plug. Preferably, each of the lamellae comprises a bulge that stands out in a radially inward direction. Further preferably, the bulge of the annular socket part is configured for supporting the respective bulge of the lamellae when the lamellae are resiliently deformed in a radially outward direction. In this regard, the shape of the lamellae's bulge may for example correspond to the shape of the annular socket part's bulge. For example, the bulge of the annular socket part may be a circumferential bulge. Preferably, the longitudinal position of the lamellae's bulge corresponds to the longitudinal position of the annular socket part's bulge, with the annular socket part's bulge being configured for supporting the lamellae's bulge when the lamellae are resiliently deformed in a radially outward direction. In a yet further preferred embodiment, the longitudinal position of the lamellae's bulge and the longitudinal position of the annular socket part's bulge are within a longitudinal range of 15% of the socket's dimension when viewed in the socket's mating direction. Preferably, the annular socket part's bulge is part of the supporting surface provided by the annular socket part.

When viewed in the mating direction of the socket, each of the lamellae may for example comprise a first section that tapers in the mating direction of the socket, a bulge that stands out in a radially inward direction and a second section that widens in the mating direction of the socket. Preferably, the lamellae's second sections are configured for accepting a connecting plug when the connecting plug is inserted into the socket.

According to a preferred embodiment, the inner surface of the annular socket part is implemented as a supporting surface for the lamellae. Preferably, the inner surface of the annular socket part is configured for acting as a supporting surface for the lamellae when the lamellae are resiliently deformed in a radially outward direction. The supporting surface may for example be configured for preventing a plastic deformation of the lamellae when the lamellae are deformed in a radially outward direction.

Preferably, between the lamella basket and the annular socket part, both a mechanical attachment and an electrical connection are established. Preferably, the lamella basket is joined with the annular socket part by welding. For example, the lamella basket may comprise a plurality of welding straps disposed at the rear end of the lamella basket. Preferably, the welding straps are evenly arranged along the perimeter of the lamella basket's rear end. Preferably, the welding straps are bent in a radially outward direction. Further preferably, the welding straps are configured for being welded to the annular socket part at a plurality of welding spots. Thus, the lamella basket can be joined with the annular socket part at a plurality of welding points, thereby establishing both a mechanical attachment and an electrical connection of low resistance. Preferably, the welding straps are configured for being welded to the annular socket part at a plurality of welding spots circumferentially arranged at the rear rim of the annular socket part. As the mechanical attachment is established at a plurality of welding spots, the lamella basket is evenly fixed along its perimeter. A warped or contorted attachment due to uneven fastening is prevented. Preferably, the welding straps of the lamella basket are configured for establishing an extensive material bond with the annular socket part.

According to an alternatively preferred embodiment, the socket comprises a press ring arranged in the interior of the lamella basket, the press ring being configured for pressing the lamella basket against the annular socket part in a radially outward direction. Preferably, the press ring is configured for circumferentially pressing the lamella basket against the annular socket part from the inside out. Preferably, the press ring is configured for fixing the lamella basket by means of a press fit. Preferably, the annular carrier strip of the lamella basket comprises a plurality of creasings configured for providing an improved press fit. Preferably, the press ring consists of metal, preferably of steel, for example of stainless steel.

Preferably, the lamella basket consists of conductive material, preferably of metal. Further preferably, the lamella basket consists of a copper alloy such as for example a copper-nickel (CuNi) alloy or a copper-chromium (CuCr) alloy. The lamella basket may for example be formed as a stamped part, preferably as a stamp-rolled or a stamp-bent part. The annular socket part may for example consist of conductive material, preferably of metal. Further preferably, the annular socket part consists of copper or of a copper alloy. In a preferred embodiment, the annular socket part is a deep drawn part. Preferably, the annular socket part is formed by deep drawing a metal sheet, preferably a sheet of copper or of a copper alloy. Preferably, the contour of the inner surface of the annular socket part is obtained by subjecting the inner surface of the annular socket part to an embossing process. Further preferably, embossing is performed using an embossing tool, with the outer contour of the embossing tool corresponding to the envisaged contour of the annular socket part's inner surface.

Preferably, the annular socket part is integrally formed with a contact plate configured for being electrically connected with a cable. Preferably, the annular socket part and the contact plate are formed by deep drawing a metal sheet, preferably a sheet of copper or of a copper alloy.

Plug-in Connector Comprising a Socket as Described Above and a Connecting Plug

A plug-in connector according to the invention comprises a socket as described above and a connecting plug, the connecting plug being adapted for being plugged into the socket and for establishing an electrical connection with the socket.

Preferably, the plug comprises a base part and an insulating element, wherein the base part comprises a contact portion configured for establishing an electrical contact with the socket. Further preferably, the contact portion comprises a receptacle configured for accommodating the insulating element. Preferably, the insulating element comprises a ring-shaped cap arranged at the front end of the insulating element, wherein the ring-shaped cap is configured for covering a front face of the connecting plug's contact portion. Preferably, the ring-shaped cap is configured for providing a touch protection at the connecting plug's front face.

BRIEF DESCRIPTION OF THE DRAWINGS

The invention is illustrated in greater detail with the aid of schematic drawings.

The drawings show schematically.

DETAILED DESCRIPTION OF EMBODIMENTS OF THE INVENTION

Figure 1:
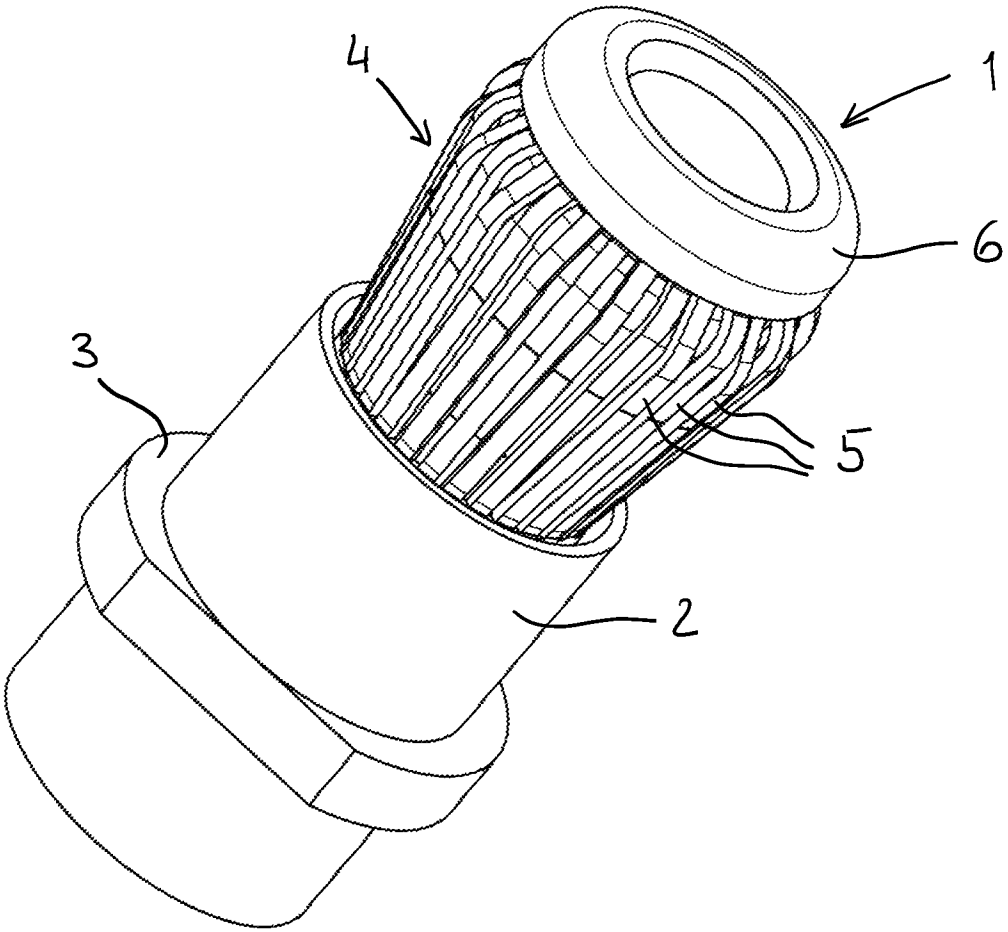
FIG. 1 shows two different views of a connecting plug.

In the following description of preferred embodiments of the present invention, identical reference numerals denote identical or comparable components.

FIG. 1 shows two perspective views of a connecting plug 1 according to embodiments of the present invention. The connecting plug 1 comprises a base element 2 with a circumferential flange 3, a lamella basket 4 with a plurality of lamellae 5 and a ring-shaped cap 6 disposed at the connecting plug's front face. The connecting plug 1 is configured for being inserted into a corresponding socket. When the connecting plug 1 is plugged into the socket, the lamellae 5 are pressed against the lateral walls of the socket and establish an electrical connection between the connecting plug 1 and the socket.

Figure 2:
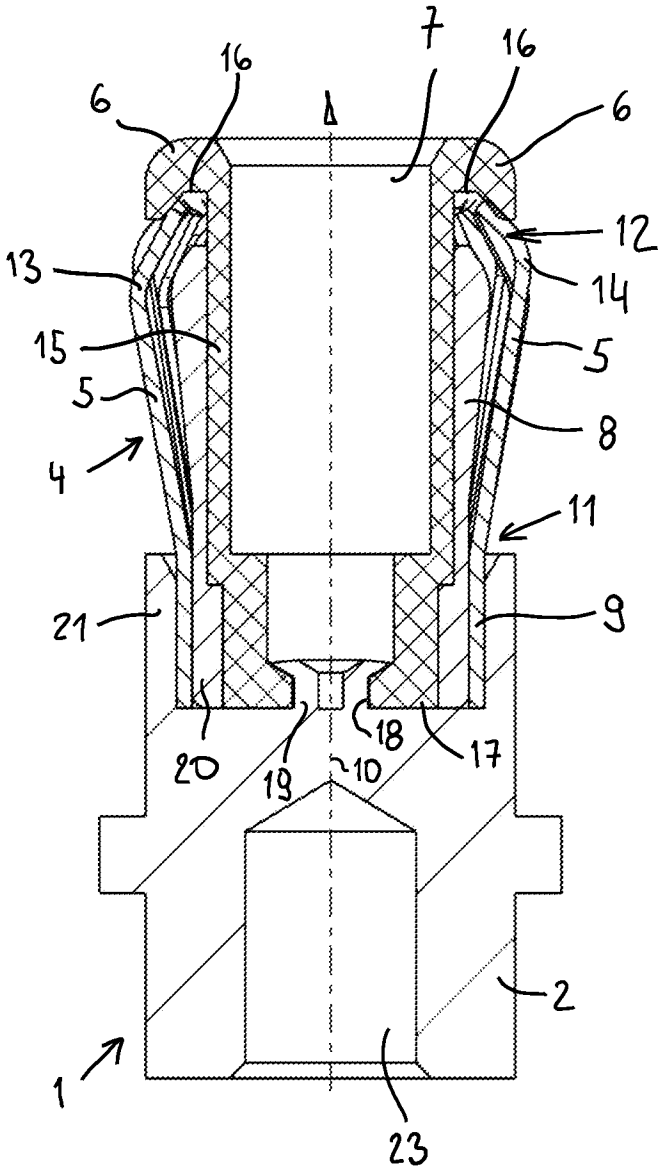
FIG. 2 shows a cross-sectional view of the connecting plug.

FIG. 2 shows a cross-sectional view of the connecting plug 1 and its components. The connecting plug 1 comprises the base element 2, the lamella basket 4 with the plurality of lamellae 5 and a holding element 7 with the ring-shaped cap 6. The connecting plug 1 further comprises a supporting sleeve 8 disposed in the interspace between the lamella basket 4 and the holding element 7. The lamella basket 4 comprises an annular carrier strip 9 and a plurality of lamellae 5. The mating direction 10 of the connecting plug 1 is indicated with an arrow. When viewed in the mating direction 10 of the connecting plug 1, the annular carrier strip 9 of the lamella basket 4 is disposed at the rear end of the lamella basket 4, with the lamellae 5 extending from the annular carrier strip 9 to the ring-shaped cap 6 predominantly in the mating direction 10 of the connecting plug 1. For each lamella 5, only the respective first end 11 is affixed to the annular carrier strip 9, whereas the second end 12 is implemented as a free end. The lamellae 5 are implemented as resilient metal strips and accordingly, each lamella 5 can be elastically deformed in a radially inward direction.

Figure 3:
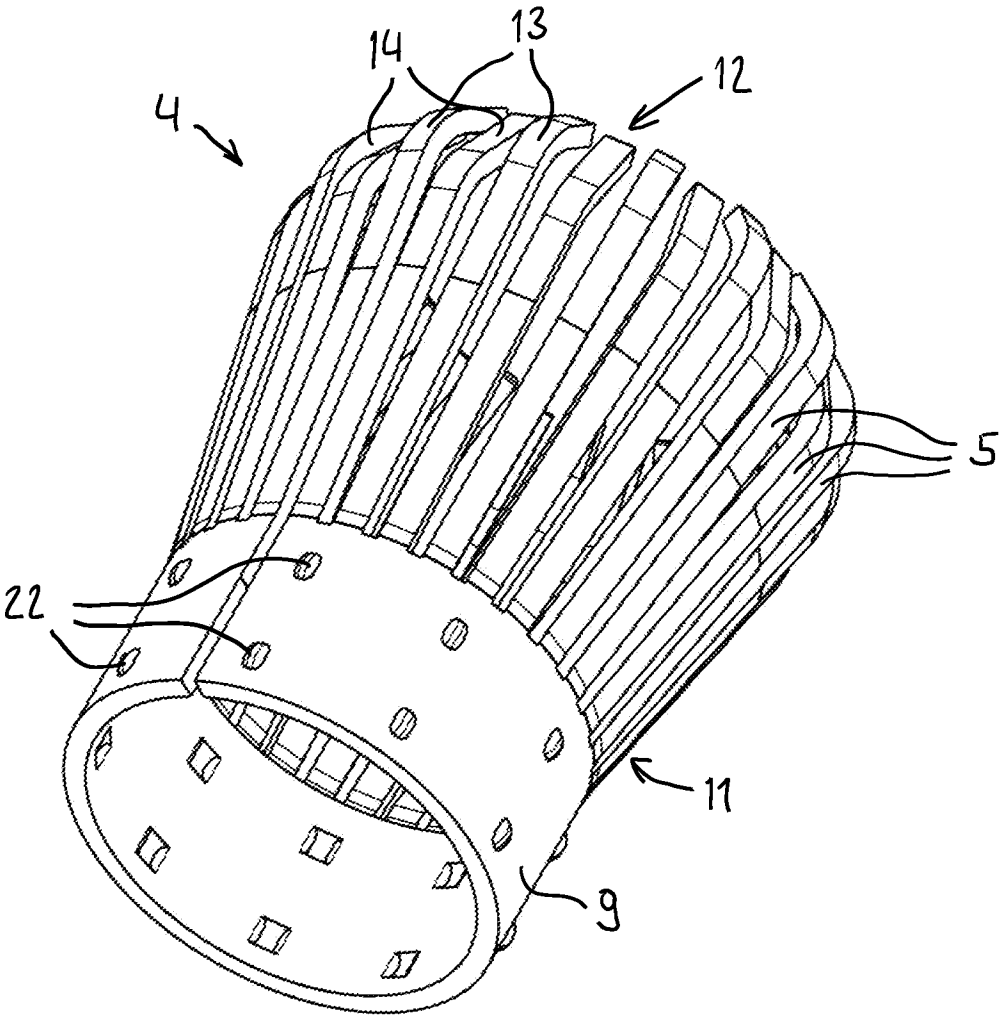
FIG. 3 shows a perspective view of the lamella basket.

In FIG. 3, a perspective view of the lamella basket 4 is given, wherein the annular carrier strip 9 and the plurality of lamellae 5 are shown. It can be seen that each of the lamellae 5 is connected at its respective first end 11 to the annular carrier strip 9, whereas the second end 12 of each lamella 5 is a free end. Thus, the lamellae 5 are resiliently supported by the annular carrier strip 9. The lamellae 5 extend predominantly in the mating direction 10 of the connecting plug 1 towards the front end of the connecting plug 1. In a preferred embodiment, the annular carrier strip 9 and the lamellae 5 are integrally formed in one piece. Preferably, the lamella basket 4 is formed as a stamped part.

Each of the lamellae 5 has a contact area 13, 14 that stands out in the radially outward direction of the lamella basket. The contact areas 13, 14 are implemented as bulges that protrude in the radially outward direction. Preferably, the contact areas of different sets of lamellae 5 are located at different longitudinal positions when viewed in the mating direction 10 of the connecting plug 1. For example, for a first subset of lamellae, the lamellae's contact areas 13 are located at a first longitudinal position, wherein for a second subset of lamellae 5, the lamellae's contact areas 14 are located at a second longitudinal position, with the first longitudinal position being different from the second longitudinal position. As shown in FIG. 3, the lamellae with the contact area 13 at the first longitudinal position are disposed alternatingly with the lamellae having the contact areas 14 at a respective second longitudinal position. By arranging the contact areas of the lamellae 5 at different longitudinal positions, the mechanical resistance for inserting the connecting plug 1 into a corresponding socket is reduced. When the connecting plug 1 is inserted into the socket in the connecting plug's mating direction 10, first, the lamellae with the contact areas 13 at the first longitudinal position are pressed in a radially inward direction. When the connecting plug 1 is further inserted into the corresponding socket, the lamellae 5 with the contact areas 14 located at the respective second longitudinal positions are pressed in the radially inward direction. Instead of deforming all the lamellae 5 at the same time, different subsets of the lamellae are deformed one after the other and thus, the overall mechanical resistance is decreased and the insertion force is reduced. In the example shown in FIGS. 2 and 3, the contact areas 13, 14 are located at two different longitudinal positions, but they may as well be located at three or more longitudinal positions.

The lamella basket 4 consists of conductive material. The lamella basket 4 may for example consist of metal, for example of a copper alloy such as for example a copper-nickel (CuNi) alloy or a copper-chromium (CuCr) alloy. In order to provide for an improved electrical contact, the lamella basket 4 may be subjected to plating, for example with gold, silver or copper. Additionally or alternatively, the base element 2 may be subjected to plating as well. The lamella basket 4 may be formed as a stamped part, for example as a stamp-rolled part or as a stamp-bent part. In particular, the lamella basket 4 shown in FIG. 3 can be formed by manufacturing a lamella strip and bending the lamella strip in a way that the lamella basket 4 is obtained.

As shown in FIG. 2, the connecting plug 1 further comprises a holding element 7 that is at least partly disposed in the interior of the lamella basket 4. The holding element 7 comprises a central sleeve 15 and the ring-shaped cap 6 arranged at the front end of the connecting plug 1. The ring-shaped cap 6 and the central sleeve 15 may be formed in one piece. For example, the ring-shaped cap 6 and the central sleeve 15 may be integrally moulded. Alternatively, the ring-shaped cap 6 and the central sleeve 15 can be formed as separate parts.

The ring-shaped cap 6 has a protruding edge that projects from the central sleeve 15 in a radially outward direction. At the rear side of the ring-shaped cap 6, a circumferential groove 16 is located, said groove 16 being configured for accommodating the respective second ends 12 of the lamellae 5. When inserting the holding element 7 into the interior of the lamella basket 4, the second ends 12 of the lamellae 5 are introduced into the circumferential groove 16. Thus, the respective second ends 12 of the lamellae 5 are held in place by the sidewalls of the groove 16, wherein a certain moving space for the second ends 12 is provided. Instead of a groove 16, a recess or one or more indentations may be located at the rear side of the ring-shaped cap 6.

Preferably, for inserting the second ends 12 of the lamellae 5 into the groove 16, the lamellae 5 have to be slightly deformed in a radially inward direction such that the lamellae 5 are pretensioned. Due to this pretension, the alignment of the lamellae 5 is improved. The protruding edge of the ring-shaped cap 6 covers the respective second ends 12 of the lamellae 5. The protruding edge prevents that any kind of counterpart can be inserted into an interspace between the lamellae 5 and the holding element 7, which may deform and damage the lamellae 5. Thus, the ring-shaped cap 6 protects the lamellae 5 from damages.

The ring-shaped cap 6 provides a touch protection at the front face of the connecting plug 1. The ring-shaped cap 6 and preferably the entire holding element 7 may consist of insulating material like for example a plastic material, a polymer material, an elastomer like for example natural rubber or synthetic rubber, etc. The ring-shaped cap 6 and preferably the entire holding element 7 can be formed by injection moulding. The ring-shaped cap 6 serves as a touch protection at the front face of the connecting plug 1. In case a user inadvertently touches the connecting plug's front face, he or she will not get in contact with live parts of the connecting plug 1.

The base part 2 comprises a receptacle 17 that may for example be implemented as a cylindrical opening. The receptacle 17 is configured for accommodating the annular carrier strip 9 of the lamella basket 4.

The connecting plug 1 further comprises a supporting sleeve 8 disposed in the interspace between the central sleeve 15 and the lamella basket 4. The supporting sleeve 8 comprises a ring-shaped rear part 20 configured for being accommodated in the receptacle 17 of the base element 2. From the rear part 20, the supporting sleeve 8 extends in the direction towards the cap 6 of the holding element 7. The supporting sleeve 8 may for example extend up to the contact areas 13, 14 of the lamellae 5. The supporting sleeve 8 is configured for providing a rigid support for the lamellae 5. In particular, in case the connecting plug is inserted into a socket in a slanted direction, the rim of the socket may exert a force on the lamellae 5 and may cause a deformation of the lamellae 5 in a radially inward direction. Due to the presence of the rigid supporting sleeve 8, any plastic deformation of the lamellae 5 is prevented. The presence of the supporting sleeve 8 ensures that the lamellae 5 maintain their shape during use of the connecting plug 1. Preferably, the lamella basket 4, the supporting sleeve 8 and the holding element 7 are implemented as rotationally symmetric components. Further preferably, the lamella basket 4, the supporting sleeve 8 and the holding element 7 are arranged coaxially with regard to the mating direction 10 of the connecting plug 1. Preferably, the supporting sleeve 8 consists of metal, for example of stainless steel. The supporting sleeve 8 may for example be formed by turning or by deep drawing.

According to a preferred embodiment which is not shown in the figures, the supporting sleeve may comprise a plurality of supporting lamellae, with the supporting lamellae of the supporting sleeve providing a resilient support for the lamellae 5 of the lamella basket 4. Because of the additional resilient support, the contact force required for deforming the lamellae 5 is increased. The advantage of this embodiment is that the relaxation resistance of the lamellae 5 is improved, which means that the spring force of the lamellae 5 can be maintained for a long period of time. This allows for realising a high-performance connector configured for ensuring reliable operation for an extended period of time. In particular, this embodiment allows increasing the upper limit temperature to more than 200° C.

The connecting plug 1 further comprises the base element 2 configured for holding the lamella basket 4, the supporting sleeve 8 and the holding element 7. The base element 2 comprises the receptacle 17, the receptacle 17 being configured for accommodating the annular carrier strip 9 of the lamella basket 4, the rear part 20 of the supporting sleeve 8 and the rear part of the holding element 7. The annular carrier strip 9 of the lamella basket 4 is fixed by means of a press fit between the encompassment 21 of the receptacle 17 and the rear part 20 of the supporting sleeve 8. In this respect, the rear part 20 of the supporting sleeve 8 serves as a counterpart of the encompassment 21. As shown in FIG. 3, the annular carrier strip 9 of the lamella basket 4 comprises a plurality of creasings 22. These creasings 22 of the annular carrier strip 9 are configured for being deformed when the press fit is established, thereby improving the press fit. As a result, the annular carrier strip 9 of the lamella basket 4 is tightly fixed between the encompassment 21 of the receptacle 17 and the rear part 20 of the supporting sleeve 8.

After the annular carrier strip 9 of the lamella basket 4 and the rear part 20 of the supporting sleeve 8 are fastened, the holding element 7 is inserted into the interior of the lamella basket 4 and the supporting sleeve 8. The base element 2 comprises a connecting element 19 configured for fixing the holding element 7, and at the rear end of the holding element 7, a bore hole 18 is located. When the holding element 7 is inserted, the connecting element 19 extends through the bore hole 18. Then, the holding element 7 can be fixed by subjecting the connecting element 19 to a shaping technique like for example flanging.

The base element 2 may further comprise a circumferential flange 3 and a bore hole 23 disposed at the rear face of the base element 2. The bore hole 23 may be configured for mounting the connecting plug 1 by means of a thread-forming screw. The base element 2 may be made of metal, preferably of a copper alloy, such as for example brass or a copper-tellurium (CuTeP) alloy. The base element 2 may be formed by turning or by impact extrusion.

According to an alternative embodiment which is not shown in the figures, the supporting sleeve 8 only consists of the ring-shaped rear part 20 and does not extend towards the connecting plug's front end. In this embodiment, the supporting sleeve 8 is provided to serve as a counterpart of the encompassment 21 for establishing a tight press fit. The supporting sleeve does not act as a support for the lamellae 5.

Figure 4:
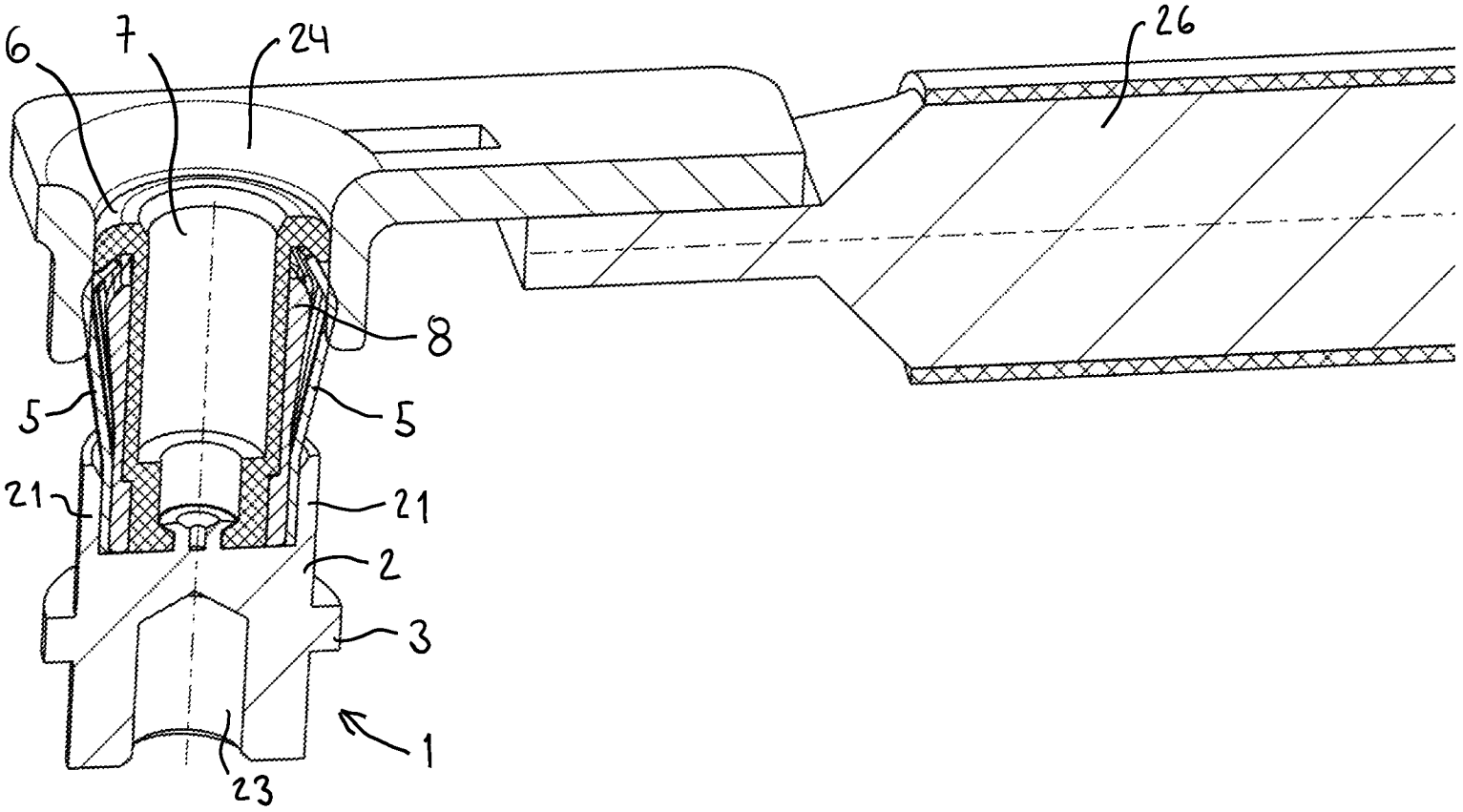
FIG. 4 shows a plug-in connector comprising a connecting plug and a socket.

FIG. 4 shows a plug-in connector, with the plug-in connector comprising the connecting plug 1 and a corresponding socket 24. The socket 24 may for example be formed by stamping a metal sheet 25. For electrically connecting the socket 24, a wire 26 may be welded to the metal sheet 25. In FIG. 4, the connecting plug 1 is inserted into the socket 24, with the lamellae 5 of the connecting plug 1 being resiliently deformed in a radially inward direction by the sidewalls of the socket 24. Thus, a reliable electrical contact is established between the contact areas 13, 14 of the lamellae 5 and the sidewalls of the socket 24.

In the embodiment shown in FIGS. 1 to 4, a connecting plug with a lamella basket has been described. Alternatively, the lamella basket may as well be provided on the part of the socket. In FIGS. 5 to 7B, a socket comprising a lamella basket configured for establishing an electrical contact with a connecting plug is shown.

Figure 5:
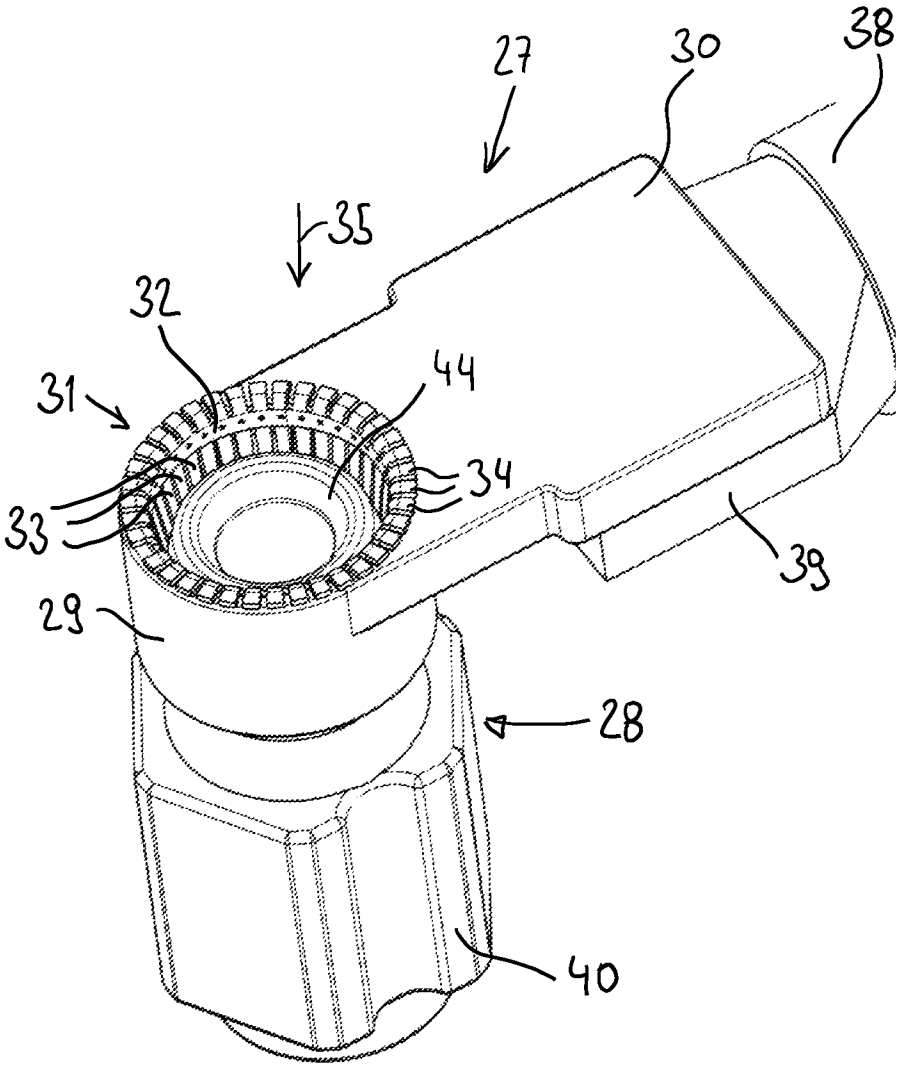
FIG. 5 shows a perspective view of a socket with a lamella basket together with a connecting plug.
Figure 6:
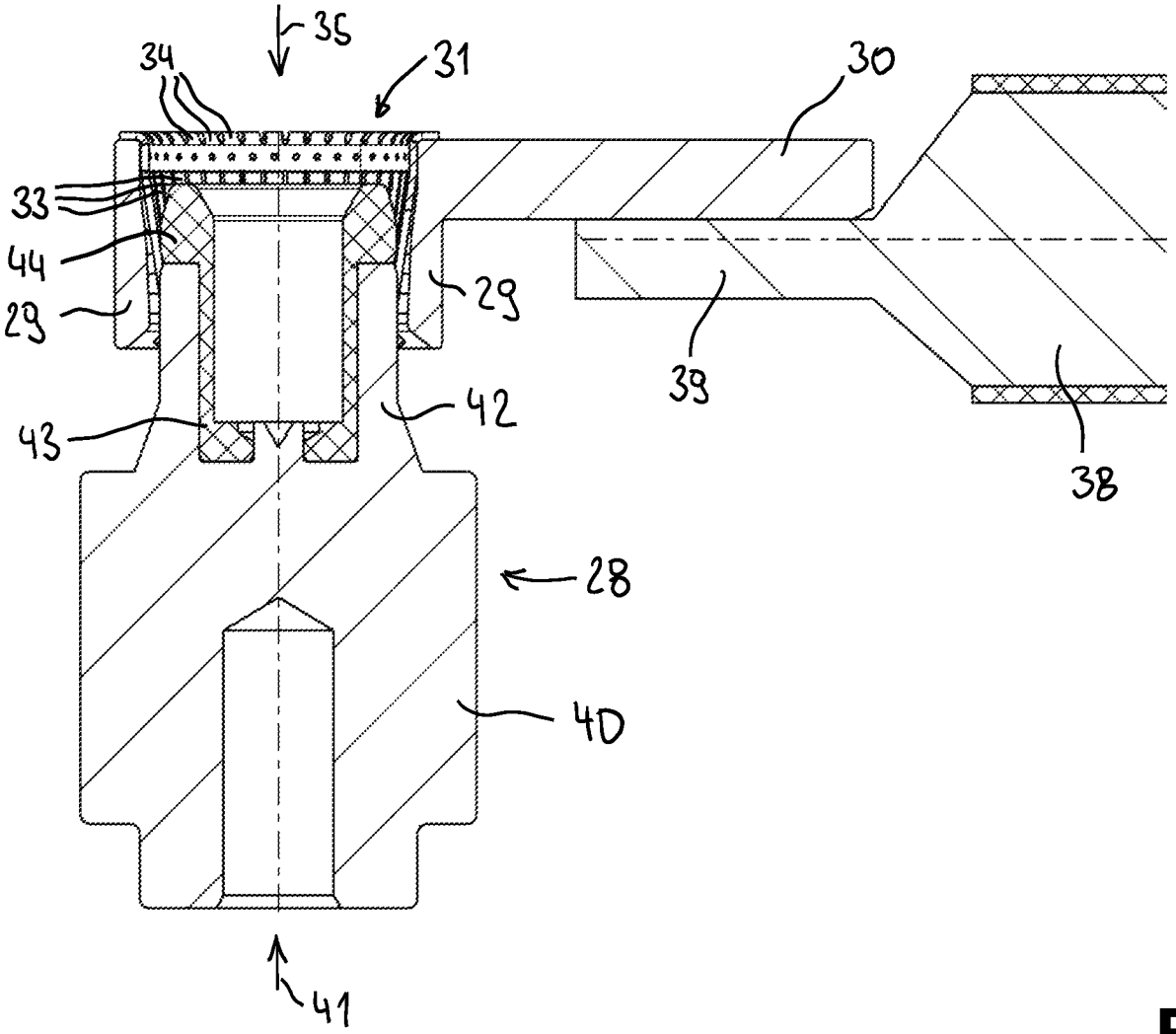
FIG. 6 shows a cross-sectional view of the socket with a lamella basket together with a connecting plug.

FIG. 5 gives a perspective view and FIG. 6 shows a cross-section of a socket 27 together with a corresponding connecting plug 28. The socket 27 comprises an annular socket part 29 and a contact plate 30 attached to or integrally formed with the annular socket part 29, wherein both the annular socket part 29 and the contact plate 30 consist of conductive material, preferably of metal. For example, the annular socket part 2 and the contact plate 30 may be integrally formed as a deep-drawn part.

The lamella basket 31 is at least partly disposed in the interior of the annular socket part 29. The lamella basket 31 comprises an annular carrier strip 32, a plurality of lamellae 33 and a plurality of outwardly bent straps 34. The outwardly bent straps 34 may for example serve as welding straps. The mating direction 35 of the socket 27 is indicated with an arrow. When viewed in the mating direction 35, the annular carrier strip 32 is located in the rear part of the lamella basket 31.

Figure 7A:
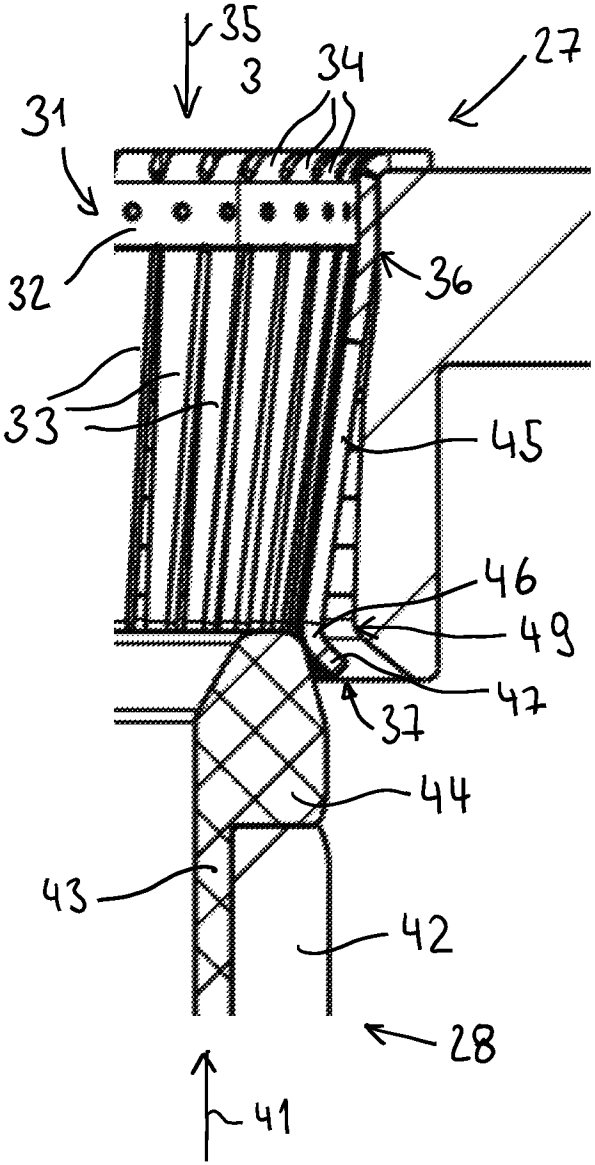
FIG. 7A shows how the connecting plug is inserted into the socket.
Figure 7B:
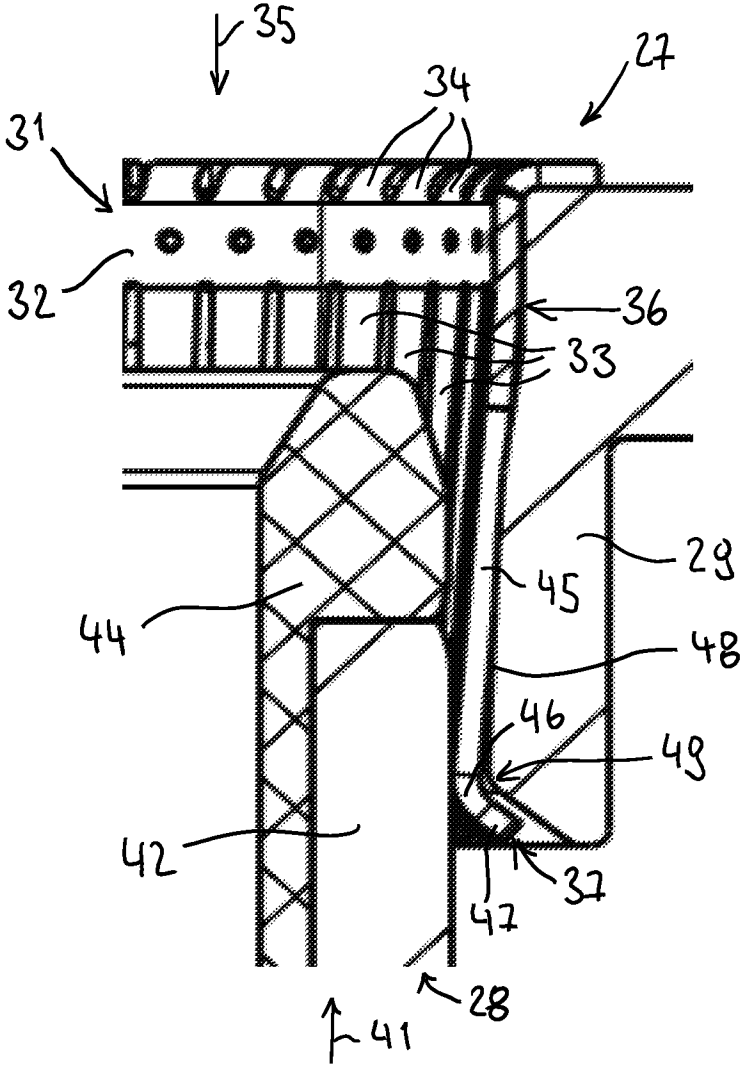
FIG. 7B shows how an electric contact between the connecting plug and the socket's lamella basket is established.

As shown in FIGS. 7A and 7B, each of the lamellae 33 has a first end 36 and a second end 37, wherein the first end 36 is fixed and the second end 37 is implemented as a free end. The first end 36 of each of the lamellae 33 is firmly attached to or integrally moulded with the annular carrier strip 32. The lamellae 33 extend from the annular carrier strip 32 along the inner side walls of the annular socket part 29 towards the front end of the socket 27. Preferably, each of the lamellae 33 extends from the annular carrier strip 32 towards the front end of the socket 27 predominantly in the mating direction 35. In this regard, the predominant component of the lamellae's orientation is the component in the mating direction 35. Each of the lamellae 33 is a convex curved lamella that stands out in a radially inward direction. Each of the lamellae 33 can be resiliently deformed in a radially outward direction. In case the connecting plug 28 is inserted into the socket 27, the lamellae 33 are resiliently deformed in a radially outward direction, whereby an electrical contact is established between the lamellae 33 and the connecting plug 28.

The lamella basket 31 consists of conductive material, preferably of metal and further preferably of a copper alloy such as for example a copper-nickel (CuNi) alloy or a copper-chromium (CuCr) alloy. The lamella basket 31 may be formed as a stamped part, for example as a stamp-rolled part or as a stamp-bent part. For improving the electrical contact, the lamella basket 31 may be subjected to plating, for example with gold, silver or copper. Additionally or alternatively, the annular socket part 29 and the contact plate 30 may be subjected to plating as well.

For mechanically and electrically connecting the lamella basket 31 with the annular socket part 29, the lamella basket 31 may be welded to the annular socket part 29. In this regard, the outwardly bent straps 34 may serve as welding straps configured for being welded to the rear portion of the annular socket part 29 at a plurality of welding spots. The total area of the welding spots is sufficiently large for establishing an extensive material closure between the lamella basket 31 and the annular socket part 29. Thus, both a mechanical fixing and an electrical connection are established between the lamella basket 31 and the annular socket part 29. According to an alternative solution, the lamella basket 31 may for example be fixed to the annular socket part 29 by means of a press ring. The press ring may for example be configured for circumferentially pressing the annular carrier strip 32 against the annular socket part 29 in a radially outward direction. The press ring may be configured for establishing a press fit between the annular carrier strip 32 and the annular socket part 29.

The contact plate 30 is configured for establishing an electric connection with a cable 38. For example, the contact plate 30 may be electrically connected with a cable lug 39 of the cable 38, wherein a joining technique such as for example ultrasonic welding may be employed.

The connecting plug 28 comprises a base part 40 consisting of conductive material. Viewed in the connecting plug's mating direction 41, the front end of the base part 40 is implemented as a contact portion 42. When the connecting plug 28 is inserted into the socket 27, an electrical contact is established between the contact portion 42 of the connecting plug 28 and the lamellae 33 of the socket 27. The connecting plug 28 further comprises an insulating element 43. The front part of the insulating element 43 is implemented as a ring-shaped cap 44 that protrudes in a radially outward direction and covers the front face of the contact portion 42. The ring-shaped cap 44 is configured for providing a touch protection at the connecting plug's front face. In order to fix the insulating element 43, the contact portion 42 comprises a receptacle configured for accommodating the insulating element 43. Furthermore, the base part 40 comprises a connecting element that extends through a bore hole of the insulating element 43 and allows for fixing the insulating element 43 by means of a joining technique like for example flanging. At the rear end of the base part 40, a bore hole is located, wherein said bore hole may for example be configured for accepting a thread-forming screw.

As shown in FIGS. 7A and 7B, when the connecting plug 28 is inserted into the socket 27, the lamellae 33 are elastically deformed in a radially outward direction. As the connecting plug 28 is further inserted into the socket 27, the lamellae 33 are resiliently pressed against the contact portion 42 such that an electrical contact between the lamella basket 31 and the contact portion 42 is established. Each of the lamellae 33 may for example comprise a first section 45 that tapers in the mating direction 35 of the socket 27, a bulge 46 that stands out in a radially inward direction and a second section 47 that widens in the mating direction 35 of the socket 27, with the second section 47 being configured for accepting the connecting plug 28. The inner surface of the annular socket part 29 and the rear surface of the resiliently deformed lamellae have a complementary shape. Thus, the inner surface of the annular socket part 29 serves as a supporting surface 48 for the lamellae 33 when the lamellae 33 are elastically deformed in a radially outward direction. Preferably, the contour of the supporting surface 48 provided by the annular socket part 29 corresponds to the contour of the rear side of the resiliently deformed lamellae. The inner surface of the annular socket part 29 comprises a circumferential bulge 49, with the longitudinal position of the bulge 49, viewed in the socket's mating direction 35, corresponding to the longitudinal position of the lamellae's bulge 46. The bulge 49 is configured for supporting the bulge 46 of the lamellae 33 when die lamellae 33 are resiliently deformed in a radially outward direction. By providing a supporting surface 48 that matches with the rear surface of the resiliently deformed lamellae, deformation and destruction of the lamellae 33 are prevented.

The annular socket part 29 and the contact plate 30 may be integrally formed as a deep-drawn part, for example by deep-drawing a copper sheet. Then, the contour of the inner surface of the annular socket part can for example be obtained by subjecting the inner surface of the annular socket part to an additional embossing process. For the inner surface of the annular socket part 29, close manufacturing tolerances have to be obeyed to, but in other areas of the deep-drawn part, wide manufacturing tolerances can be accepted.

The features described in the above description, claims and figures can be relevant to the invention in any combination. Their reference numerals in the claims have merely been introduced to facilitate reading of the claims. They are by no means meant to be limiting.

LIST OF REFERENCE NUMERALS

1 connecting plug
2 base element
3 flange
4 lamella basket
5 lamellae
6 ring-shaped cap
7 holding element
8 supporting sleeve
9 annular carrier strip
10 mating direction of the connecting plug
11 first end of lamella
12 second end of lamella
13 contact area of first subset of lamellae
14 contact area of second subset of lamellae
15 central sleeve
16 groove
17 receptacle
18 bore hole
19 connecting element
20 rear part of supporting sleeve
21 encompassment
22 creasings
23 bore hole
24 socket
25 metal sheet
26 wire
27 socket
28 connecting plug
29 annular socket part
30 contact plate
31 lamella basket
32 annular carrier strip
33 lamellae
34 outwardly bent straps
35 mating direction of socket
36 first end of lamellae
37 second end of lamellae
38 cable
39 cable lug
40 base part
41 mating direction of connecting plug
42 contact portion
43 insulating element
44 ring-shaped cap
45 first section of lamellae
46 bulge
47 second section of lamellae
48 supporting surface
49 bulge

The invention claimed is:

1. A socket comprising:

an annular socket part; and a lamella basket at least partly disposed in an interior of the annular socket part, the lamella basket comprising a plurality of lamellae and an annular carrier strip located at a rear portion of the lamella basket, each of the lamellae having a first end and a second end, with the first end being firmly attached to, or integrally moulded with, the annular carrier strip and with the second end being implemented as a free end, with the lamellae extending from the annular carrier strip towards a front end of the socket, wherein an inner surface of the annular socket part comprises a bulge that protrudes in a radially inward direction, wherein the bulge of the annular socket part is configured for supporting the lamellae when the lamellae are resiliently deformed in a radially outward direction.

2. The socket according to claim 1, wherein the lamellae extend from the annular carrier strip along the inner surface of the annular socket part towards the front end of the socket.

3. The socket according to claim 1, wherein a contour of the annular socket part's inner surface corresponds to a contour of a rear side of the resiliently deformed lamellae.

4. The socket according to claim 1, wherein a contour of the annular socket part's inner surface corresponds to a deflection curve of the resiliently deformed lamellae.

5. The socket according to claim 1, wherein at least one of the lamellae comprises a bulge that protrudes in a radially inward direction.

6. The socket according to claim 1, wherein the inner surface of the annular socket part is configured to act as a supporting surface for the lamellae when the lamellae are resiliently deformed in a radially outward direction.

7. The socket according to claim 1, wherein the lamella basket comprises a plurality of welding straps disposed at a rear end of the lamella basket.

8. The socket according to claim 7, wherein the welding straps are configured for being welded to the annular socket part at a plurality of welding spots.

9. The socket according to claim 1, wherein the socket comprises a press ring arranged in the interior of the lamella basket, the press ring being configured for pressing the annular carrier strip against the annular socket part.

10. The socket according to claim 1, wherein the annular socket part is formed by deep drawing.

11. The socket according to claim 1, wherein a contour of the inner surface of the annular socket part is obtained by subjecting the inner surface of the annular socket part to an embossing process.

12. A connecting plug comprising:

a lamella basket comprising a plurality of lamellae, each of the lamellae having a first end and a second end, the first end being fixed and the second end being implemented as a free end;

a holding element comprising a central body disposed in the interior of a lamella basket and a cap attached at or integrally moulded with a front end of the central body, the cap having a protruding edge that projects from the central body in a radially outward direction, wherein the cap is shaped and configured for accommodating the respective second ends of the lamellae; and a base part, with a rear portion of the lamella basket being attached to the base part, wherein the lamella basket further comprises an annular carrier strip located at the rear portion of the lamella basket, with the first end of each of the lamellae being firmly attached to, or integrally moulded with, the annular carrier strip, wherein the lamellae extend from the annular carrier strip to the holding element's cap.

13. The connecting plug of claim 12, wherein the cap consists of electrically insulating material.

14. A connecting plug comprising:

a lamella basket comprising a plurality of lamellae, each of the lamellae having a first end and a second end, the first end being fixed and the second end being implemented as a free end;

a holding element comprising a central body disposed in an interior of the lamella basket and a cap attached at, or integrally moulded with, a front end of the central body, the cap having a protruding edge that projects from the central body in a radially outward direction, wherein the cap is shaped and configured for accommodating the respective second ends of the lamellae, and a base part, with a rear part of the lamella basket being attached to the base part, wherein the connecting plug further comprises a supporting sleeve arranged in the interspace between the lamella basket and the holding element, the supporting sleeve being configured and shaped for providing a support for the lamellae resiliently by means of supporting lamellae.

15. A plug-in connector comprising a connecting plug according to claim 12 and a socket, the connecting plug being adapted for being plugged into the socket and for establishing an electrical connection with the socket.

* * * * *